US007273113B2

(12) United States Patent
Spektor

(10) Patent No.: US 7,273,113 B2
(45) Date of Patent: Sep. 25, 2007

(54) REVERSIBLE PENETRATING MACHINE WITH A DIFFERENTIAL AIR DISTRIBUTING MECHANISM

(76) Inventor: Michael B. Spektor, 6613 SW. 88th Ave., Portland, OR (US) 97223

( * ) Notice: Subject to any disclaimer, the term of this patent is extended or adjusted under 35 U.S.C. 154(b) by 260 days.

(21) Appl. No.: 11/081,064

(22) Filed: Mar. 16, 2005

(65) Prior Publication Data

US 2006/0207794 A1 Sep. 21, 2006

(51) Int. Cl.
*E21B 4/14* (2006.01)
*E21B 7/26* (2006.01)

(52) U.S. Cl. ..... 175/19; 173/91

(58) Field of Classification Search ..... 175/19, 175/296, 293; 173/90, 91
See application file for complete search history.

(56) References Cited

U.S. PATENT DOCUMENTS

| | | | | |
|---|---|---|---|---|
| 3,651,874 | A | 3/1972 | Sudnishnikov et al. | |
| 3,708,023 | A | 1/1973 | Nazarov et al. | |
| 3,727,701 | A | 4/1973 | Sudnishnikov et al. | |
| 3,744,576 | A | 7/1973 | Sudnishnikov et al. | |
| 3,756,328 | A | 9/1973 | Sudnishnikov et al. | |
| 3,865,200 | A | 2/1975 | Schmidt | |
| 4,078,619 | A | 3/1978 | Sudnishnikov et al. | |
| 4,214,638 | A | 7/1980 | Sudnishnikov et al. | |
| 5,031,706 | A | 7/1991 | Spektor | |
| 5,226,487 | A | 7/1993 | Spektor | |
| 5,311,950 | A | 5/1994 | Spektor | |
| 5,467,831 | A | 11/1995 | Spektor | |
| 5,505,270 | A * | 4/1996 | Wentworth | 173/1 |
| 5,603,383 | A * | 2/1997 | Wentworth et al. | 173/91 |
| 6,467,554 | B1 * | 10/2002 | Millican | 173/91 |
| 6,923,270 | B1 * | 8/2005 | Randa | 173/91 |
| 6,953,095 | B2 * | 10/2005 | Randa | 173/1 |

* cited by examiner

*Primary Examiner*—David Bagnell
*Assistant Examiner*—David Andrews

(57) ABSTRACT

The invention represents a new design of a reversible penetrating machine (90) with a pneumatically controlled differential air distributing mechanism. This design eliminates the springs, the rear anvil assembly, and several other components found in the prior machine. The chisel and the tail of the machine are also redesigned to eliminate the need of a special attachment in case of retracting a failed machine. In addition, a simplified modification of the machine for special applications is disclosed in which the rear valve chest with associated parts is replaced by a single flange having appropriate air ducts. Finally, the new design of the chisel causes a reduction of the lateral friction between the body of the machine and soil. All this significantly increases the reliability and efficiency of the machine and results in decrease of the related manufacturing and operating cost.

9 Claims, 13 Drawing Sheets

SECTION 1-1

SECTION 3-3

SECTION 2-2

SECTION 4-4

SECTION 4-4

SECTION 5-5

SECTION 6-6

REVERSIBLE PENETRATING MACHINE WITH A DIFFERENTIAL AIR DISTRIBUTING MECHANISM

FIELD OF THE INVENTION

The present invention belongs to the group of reversible pneumopercussive soil-penetrating machines used mainly for making underground horizontal holes and driving pipes and cables into these holes. In the mining industry, these machines are used for making ventilation holes as well as for driving explosives into these holes.

BACKGROUND OF THE INVENTION

Reversible pneumopercussive soil-penetrating machines have long been known and widely used in the industry of trenchless installation and repair of pipes and cables. These machines basically comprise a tubular body, accommodating in the rear part of it an air distributing mechanism, in front part of it a sharpened chisel, and inside of it a reciprocating striker. The rear part of the chisel represents a front anvil. A tail nut in the rear part of the tubular body secures the interior assembly of the machine, keeping together the related components. A pneumatic hose is concentrically attached to the rear part of the air distributing mechanism, supplying the machine with compressed air. The air distributing mechanism controls the flow of the compressed air in a certain order, causing the striker to cyclically reciprocate inside of the tubular body. A single cycle of machine operation consists of a forward and backward stroke of the striker. During the forward mode of operation, the striker imparts an impact to the front anvil at the end of its forward stroke, resulting in an incremental penetration of the machine into the soil. The striker then begins its backward stroke, at the end of which the striker is braked by an air buffer, preventing or minimizing the impact to the rear anvil. During the reverse mode of operation, an air buffer prevents or minimizes the impact of the striker to the front anvil, while at the end of the backward stroke the striker imparts an impact to the rear anvil, causing an incremental backward displacement of the machine.

This type of reversible pneumopercussive soil-penetrating machine is described in U.S. Pat. No. 3,651,874 (March 1972); U.S. Pat. No. 3,708,023 (January 1973); U.S. Pat. No. 3,737,701 (April 1973); U.S. Pat. No. 3,744,576 (July 1973); U.S. Pat. No. 3,756,328 (September 1973); U.S. Pat. No. 3,865,200 (February 1975); U.S. Pat. No. 4,078,619 (March 1978); U.S. Pat. No. 4,214,638 (July 1980). All these patented machines have identical short-stroke air distributing mechanisms, resulting in relatively low impact energy per blow, which in turn results in relatively short incremental displacement per cycle. A detailed analysis of these patents is presented in U.S. Pat. No. 5,031,706 (July 1991) and U.S. Pat. No. 5,226,487 (July 1993) issued to Spektor (the author of the present invention).

The present inventor has developed and published analytical methodologies for optimizing cyclic soil-working processes with respect to minimum energy consumption. These methodologies show that minimum energy consumption can be achieved at a certain optimum displacement per cycle (see Minimization of Energy Consumption of Soil Deformation, Journal of Terramechanics, 1980, Volume 17, No. 2 pages 63 to 77; Principles of Soil-Tool Interaction, Journal of Terramechanics, 1981, Volume 18, No. 1, pages 51 to 65; Motion of Soil-Working Tool Under Impact Loading, Journal of Terramechanics, 1981, Volume 18, No. 3, pages 133 to 156; Working processes of Cyclic-Action Machinery for Soil Deformation-Part I, Journal of Terramechanics, 1983, Volume 20, No. 1, pages 13 to 41; Minimum Energy Consumption of Soil Working Cyclic Processes, Journal of Terramechanics, 1987, Volume 24, No. 1, pages 95 to 107). Based on these investigations, the performance of the existing vibratory soil working machines can be evaluated by comparing their displacement per cycle with the respective optimum displacement. On analyzing these comparisons, it became apparent that the existing machines could only develop displacements per cycle that are significantly shorter than the respective optimum displacements. This results in relatively high energy consumption and relatively low productivity (average velocity). In order to improve the efficiency of these machines it is necessary to considerably increase the impact energy of the striker. This is achievable trough a significant increase of the stroke of the striker, while keeping the nominal air pressure unchanged (because the nominal air pressure of 100 psi is standard among the vast majority of industrial air compressors). However, the existing machines incorporate a short-stroke air distributing mechanism, and it is inherently impossible to significantly increase the stroke of their strikers. Based on all these considerations, the author of the present invention developed a reversible pneumopercussive soil-penetrating machine that is characterized by a long-stroke air distributing mechanism, which is described in U.S. Pat. No. 5,311,950 issued to Spektor in May 1994. This machine, due to its long-stroke air distributing mechanism allowed improved performance, however several structural complexities of this machine increased its cost while limiting its efficiency. In order to overcome these disadvantages, the author of the present invention developed a monotube reversible pneumopercussive soil penetrating machine with stabilizers, which is described in U.S. Pat. No. 5,457,831 issued to Spektor in November 1995. Laboratory and field testing of numerous machines based on this patent demonstrated a considerable increase of the efficiency of the machine with significantly reduced cost. However, extensive testing of these machines revealed several severe disadvantages that prevented the implementation of these machines.

The most critical disadvantage is associated with the fatigue failure of the spring that exerts an outward thrust on the stroke control valve and the follower and the spring that exerts an outward thrust on the relief valve. These failures occurred in most of the machines, and it was necessary to frequently replace these springs as preventive maintenance against failure. The appropriate engineering calculations associated with this specific case show that the fatigue failure could be avoided with a significant increase in length of the springs, but this would require a respective increase of the length, weight, complexity, and cost of the machine, along with a significant decrease of its efficiency.

Another disadvantage of the considered machine is related to the need of the mentioned follower and associated components such as the spacer and a separated rear anvil. First of all, the structural design of these components makes it extremely difficult to extract a small fragment of a broken spring. This fragment may cause a moving part of the machine to jam, resulting in failure of the machine. Secondly, securing the rear anvil by means of press fit and pins increases the manufacturing cost of the machine. Thirdly, fabricating and assembling all these associated parts also increases the cost of the machine.

Still another disadvantage of the considered machine is that the frictional force between the inner surface of the rear valve chest and the O-ring on the relief valve changes from machine to machine due to the manufacturing tolerances, causing a need for increased pressure in the reduced (low) pressure line, resulting in decreased efficiency of the machine.

One more disadvantage of the considered machine is related to the method of retracting a failed machine from the hole. According to this method a special attachment should be mounted to the chisel of an identical machine. This attachment should engage with the tail of the failed machine, which will be retracted by reversing the second machine. Firstly, the inherent gaps between the movable parts of the attachment cause the attachment to tilt down and shave the soil on the bottom of the hole. This may sometimes prevent the engagement of the attachment with the failed machine. Secondly, the need of a special attachment leads to additional cost and maintenance.

Still one more disadvantage of the considered machine is the absence of an option to replace the rear chest assembly (comprising the rear chest, the step-bushing, the relief valve with its O-ring and spring) with a flange having appropriate air ducts. This type of machine, having a significantly reduced cost, would have many specific applications, which will be discussed later.

Another disadvantage of the considered machine as well as the existing machines is that, during operation, the entire outer surface of the tubular body is in permanent contact with the soil, developing an essential lateral friction resistance, thus decreasing the efficiency of the working process.

The machine according to the present invention is free of all these disadvantages and is characterized by an essentially higher efficiency and a significantly lower manufacturing cost. Extensive testing of these machines in laboratory and field conditions demonstrated their numerous advantages in comparison with the considered machines. It should be emphasized that the machines according to the present invention possess a very high reliability at a drastically minimized maintenance.

SUMMARY OF THE INVENTION

The invention offers a reversible penetrating machine with a pneumatically controlled differential air distributing mechanism that is characterized by significantly higher efficiency, reliability, and reduced manufacturing and maintenance costs. This is achieved in part by eliminating the failure-prone springs in the differential air distributing mechanism of the previous design with newly designed pneumatically controlled differential air distributing mechanism. Elimination of the springs prevents any reliability issues with the valves and reduces the cost of the machine.

A further aspect of the invention is the elimination of the rear anvil assembly, comprising the rear anvil, the follower, and the spacer, as well as the means for securing the rear anvil inside of the tubular body of the machine. This assembly became unneeded with the elimination of the spring that loads the stroke control valve.

Another aspect of the invention is the elimination of the relief valve O-ring, which together with the elimination of the springs, allows a decrease in the air pressure in the reduced (low) pressure line, improving the performance of the machine and also providing an opportunity for further simplification of the machine.

Another aspect of the invention is the new design of the front part (chisel) and rear part (tail) of the machine that, in the case of retracting a failed machine from a hole, allows engaging the chisel of an identical machine with the tail of the failed machine, eliminating the need for a special retracting attachment. The manufacturing cost of the new design of the chisel and tail with the integrated engagement means is comparable to the manufacturing cost of the similar parts of the previous machine; however no expenses are needed for the special attachment and its maintenance.

Another aspect of the invention is the possibility of modifying the machine for special applications. In this machine the rear valve chest, the relief valve, and the stepped adapter can be replaced with a flange that has appropriate air ducts. In this case the manufacturing and maintenance cost of the machine is reduced while the performance of the machine in certain working conditions is not compromised.

One more aspect of the invention is the significant reduction of the contact surface of the machine with the medium (soil), resulting in a respective reduction of the friction between the machine and the medium (soil) during operation. This is achieved by an appropriate enlargement of the diameter of the chisel and transfer of the guiding functions of the machine from its tubular body to the stabilizers, while preventing the tubular body from contacting the medium (soil), thereby causing an improvement in the performance of the machine.

All these and other aspects of the invention will become apparent from the detailed description of the illustrated embodiment.

BRIEF DESCRIPTION OF THE DRAWING

FIGS. 1A, 1B, and 1C, of which FIG. 1B is a continuation of FIG. 1A, and FIG. 1C is a continuation of FIG. 1B represent a longitudinal sectional view of a reversible penetrating machine with a pneumatically controlled differential air distributing mechanism. The components of the machine are positioned for the forward mode of operation at the beginning of the forward stroke of the striker. These FIGS. (1A, 1B, 1C) are recommended for the front of the patent.

DESCRIPTION OF THE ILLUSTRATED EMBODIMENT

General Description

Figure 1A:
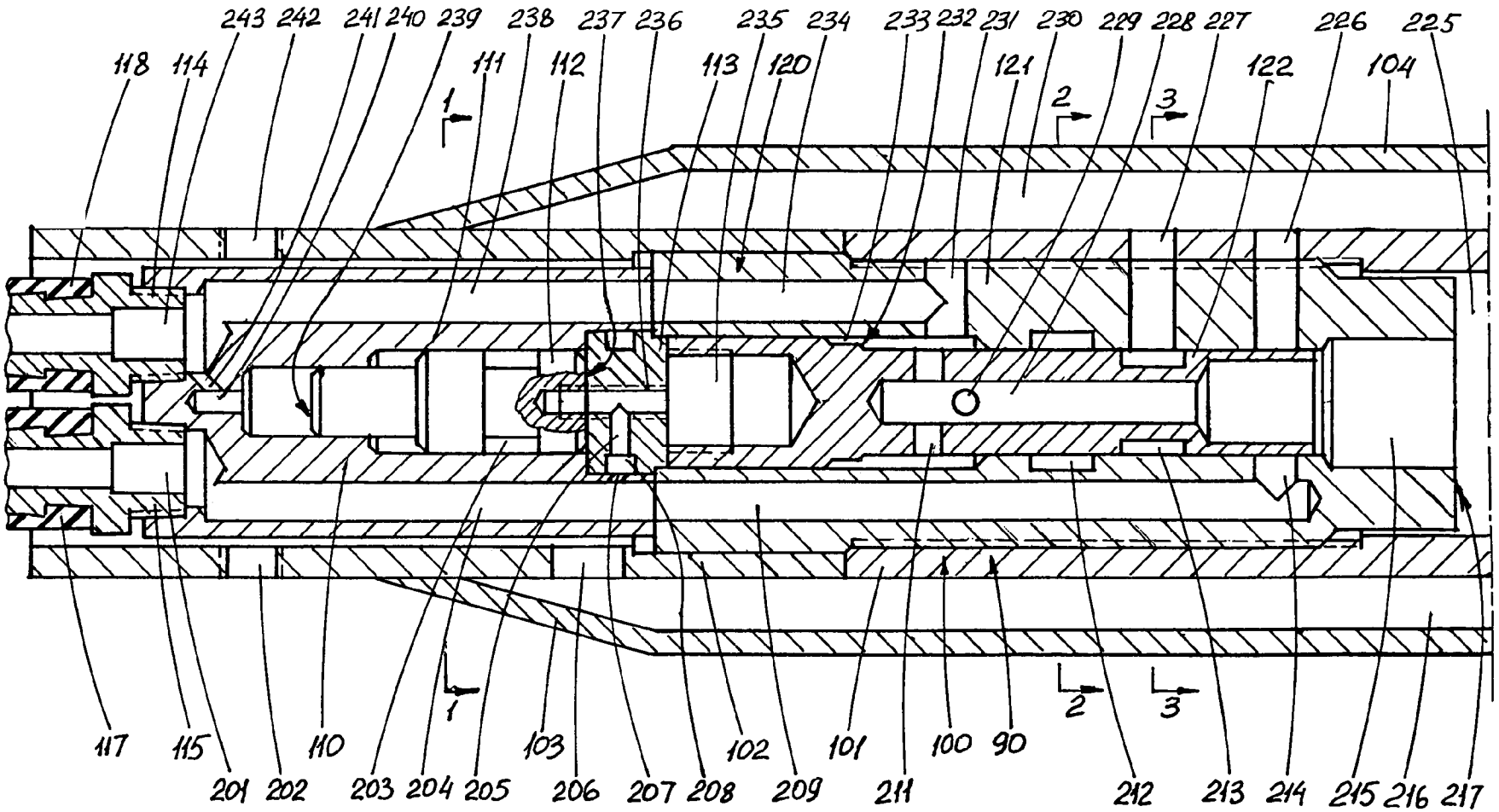
Figure 1B:
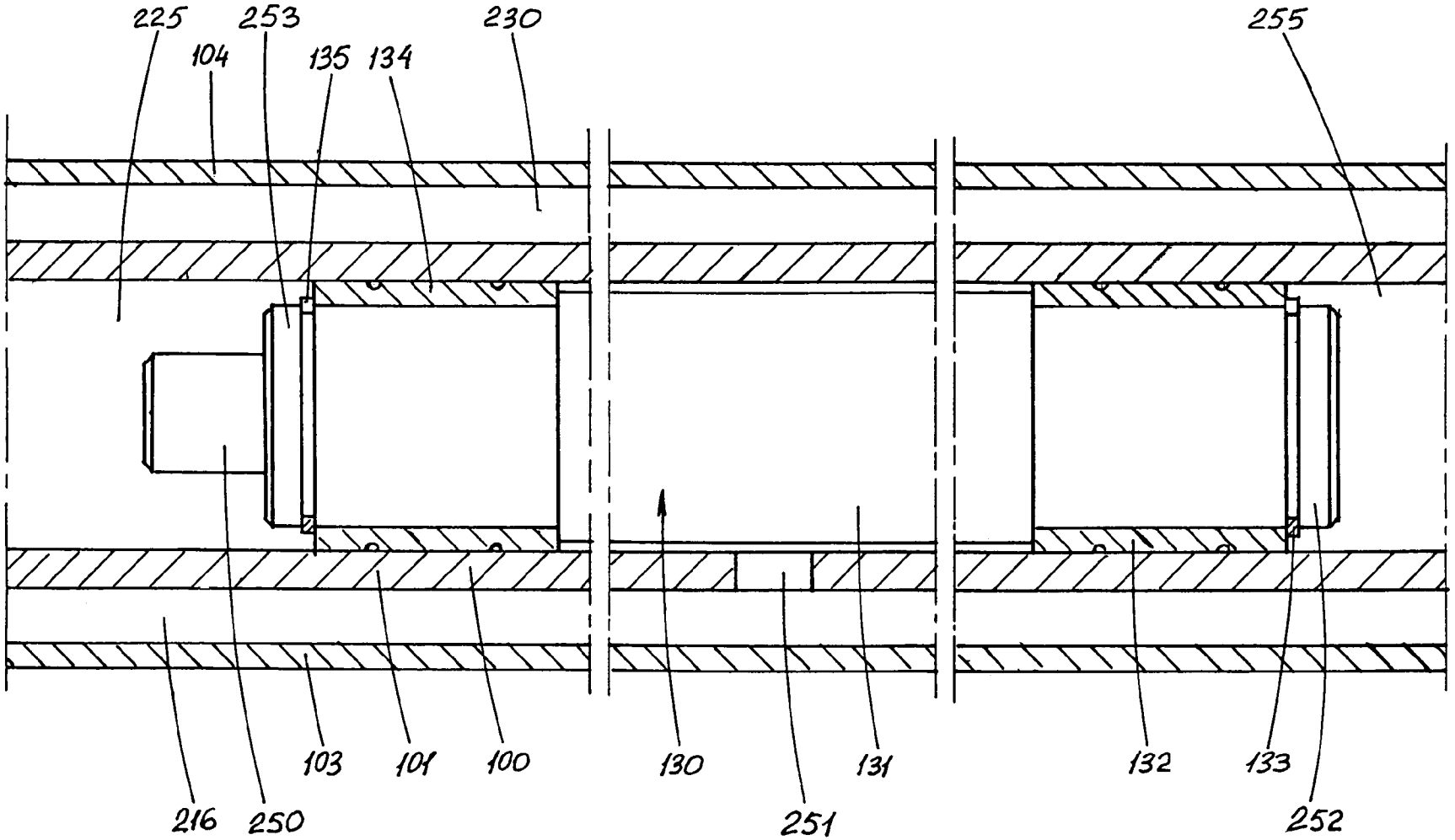
Figure 1C:
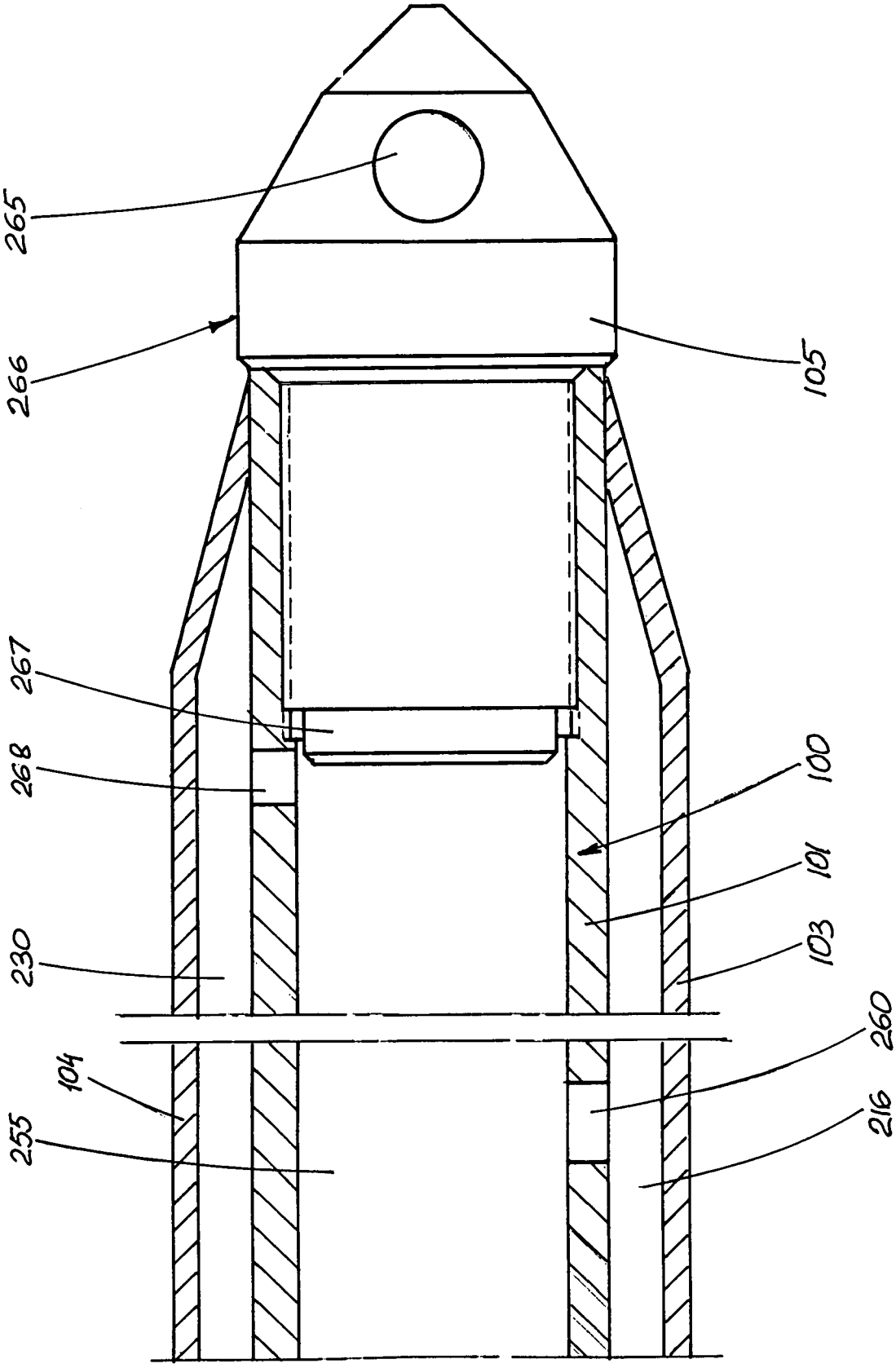
Figure 3:
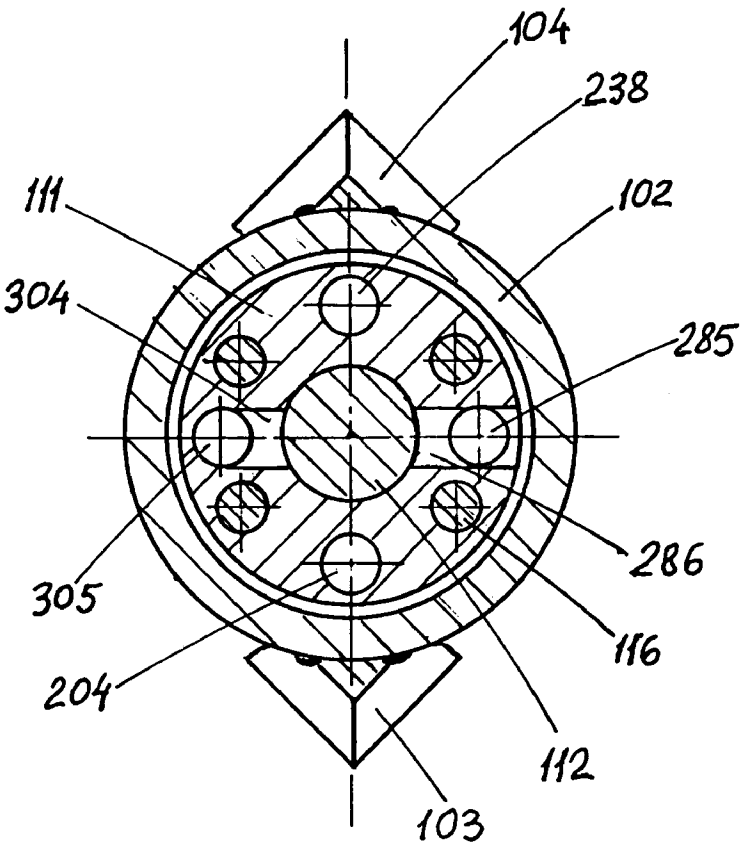
FIG. 3 is a cross-sectional view taken along the line 1-1 in FIG. 1A.

As shown in FIGS. 1A, 1B, and 1C, a reversible penetrating machine 90 with a pneumatically controlled differential air distributing mechanism according to the invention includes, as major assemblies, an elongated housing assembly 100 comprising a tubular housing (tube) 101, a protective sleeve 102, longitudinal stabilizers 103 and 104, and a chisel 105 rigidly secured by a threaded joint to the front part of tube 101; a striker assembly 130 disposed for reciprocation within tube 101; a pneumatically controlled differential air distributing mechanism comprising a front valve chest assembly 120 rigidly secured by a threaded joint to the rear part of tube 101; and a rear assembly 120. The air distributing mechanism controls the flow of the compressed air causing reciprocation of striker assembly 130. Thread-locking means are used to prevent loosening of threaded joints of tube 101 with front valve chest 121 as well as with chisel 105.

As FIGS. 1A, 1B, 1C and 2-5 illustrate, stabilizers 103 and 104 represent longitudinal structural angular shapes rigidly attached to the outer surface of tube 101 and protective sleeve 102, creating longitudinal channels 216 and 230 for delivery and exhaust of compressed air.

Referring to FIGS. 1A, and 3-7, front valve chest assembly 120 comprises a front valve chest 121 and a double stepped stroke control valve 122 reciprocating inside of front valve chest 121. The front (right) end 217 of front valve chest 121 represents a rear anvil. A radial duct 231 in front valve chest 121 is permanently connected to the nominal (high) pressure line of the source of compressed air. Due to the middle step of stroke control valve 122, an annular space 233 is always pressurized by the nominal (high) air pressure, regardless of the position of stroke control valve 122. When stroke control valve 122 is in its extreme front (right) position, radial duct 231 is just partially overlapped by stroke control valve 122 and is still connected to annular space 233. The air pressure in annular space 233 permanently develops a pressure force, acting as a spring and always pushing stroke control valve 122 to the rear (left).

Referring to FIGS. 1A, 2, 3, 6, and 7, rear valve chest assembly 110 comprises a rear valve chest 111, a hose barb 114 with a hose 118 for delivering compressed air at the nominal (high) pressure, a hose barb 115 with a hose 117 for delivering compressed air at reduced (low) pressure, a relief stepped valve 112 reciprocating inside of rear valve chest 111, a stepped adapter 113 pressed into the front (right) part of rear valve chest 111 and, being installed into the rear (left) part of front valve chest 121, aligning the two valve chests, which are connected to each other by a group of bolts 116. Compressed air at the nominal (high) pressure, being supplied through a hole 243, an inclined duct 241 and a hole 240, permanently develops a pressure force, acting like a spring, and applied to the surface 239 of the smaller step of relief valve 112 pushing it to the front (right). Compressed air at reduced (low) pressure, being supplied through a hole 201, a longitudinal hole 204, an inclined duct 207, a groove 208 in stepped adapter 113, a radial duct 205 and a threaded hole 236, develops permanent pressure forces, acting like springs, and applied to the larger steps of relief valve 112 and stroke control valve 122, pushing them to the rear (left) and front (right) respectively. The interaction between the components of front valve chest assembly 120 and rear valve chest assembly during machine operation will become apparent from the following description of the forward and reverse modes of operation of the machine.

Referring now to FIG. 1B, striker assembly 130 comprises a striker 131 reciprocating inside of tube 100, bushings 132 and 134 that are made of low friction material, and retaining rings 133 and 135. It is possible to use bronze welding electrodes to build up bushings on the striker and then machine them to the required specifications, also eliminating the need for retaining rings. The inside space between the rear end of striker assembly 130 and the front end of front valve chest 121 represents a forward stroke chamber 225. The inside space between the front end of striker assembly 130 and rear end of chisel 105 represents a backward stroke chamber 255.

The following steps may be used in order to assemble the machine:

Front valve chest 121 should be secured to the rear end of tube 101 by means of a threaded joint. Then protective sleeve 102 is pressed onto the rear part of front valve chest 101. After that, stabilizers 103 and 104 are welded to tube 101 and protective sleeve 102. Stroke control valve 122 is inserted into front chest 121 with the help of a conventional threaded bar connected to the inner thread in the left end of stroke control valve. The threaded bar is used for installation or removal of stroke control valve 122. Striker assembly 130 is inserted into tube 101 through its front (right) end, and then chisel 105 is secured to tube 101 by means of a threaded joint. Hose barbs 114 and 115 together with their hoses 117 and 118 are screwed into rear valve chest 111 that accommodates relief valve 112 and stepped adapter 113. The threads in relief valve 112 and in stepped adapter 113 are used just for assembling and disassembling purposes. After that, rear valve chest assembly 110, being aligned by means of adapter 113 with front valve chest 121, is secured to front chest 121 by a group of bolts 116 (the threaded holes for these bolts in front valve chest 121 are not shown).

An air control unit is used to supply compressed air to the machine from a compressed air source. The air control unit, comprising a conventional air filter, lubricator, and pressure regulator, splits the air into two lines, namely the nominal (high) pressure line and the reduced (low) pressure line. One switching valve could be installed in the compressed air line connecting the compressed air source with the air control unit. In this case, by switching on this valve, both lines will be pressurized simultaneously, and the machine will start to operate. If switching valves are installed on each of these lines, these valves may be opened in any sequence. Compressed air at the nominal (high) pressure is delivered to the machine by hose 118 and hose barb 114 and is used for the forward stroke of striker 131. Compressed air at reduced (low) pressure is delivered to the machine by hose 117 and hose barb 115 and is used for the backward stroke of striker 131. The adjustment of the reduced (low) pressure is performed by means of a conventional pressure regulator of the air control unit. This unit is not shown in the drawing.

Figure 11:
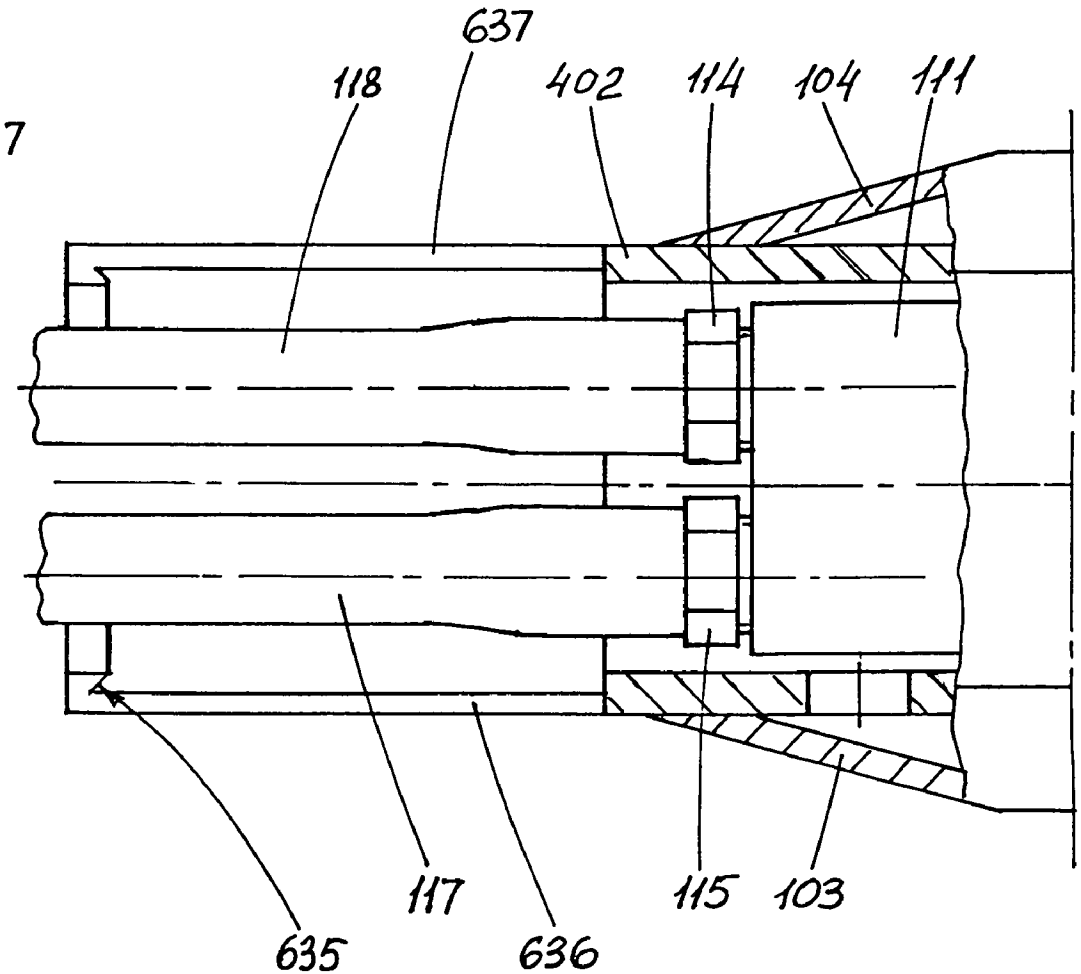
FIG. 11 is a partial longitudinal sectional view of the rear part of the machine having integrated engagement means for retraction.
Figure 10:
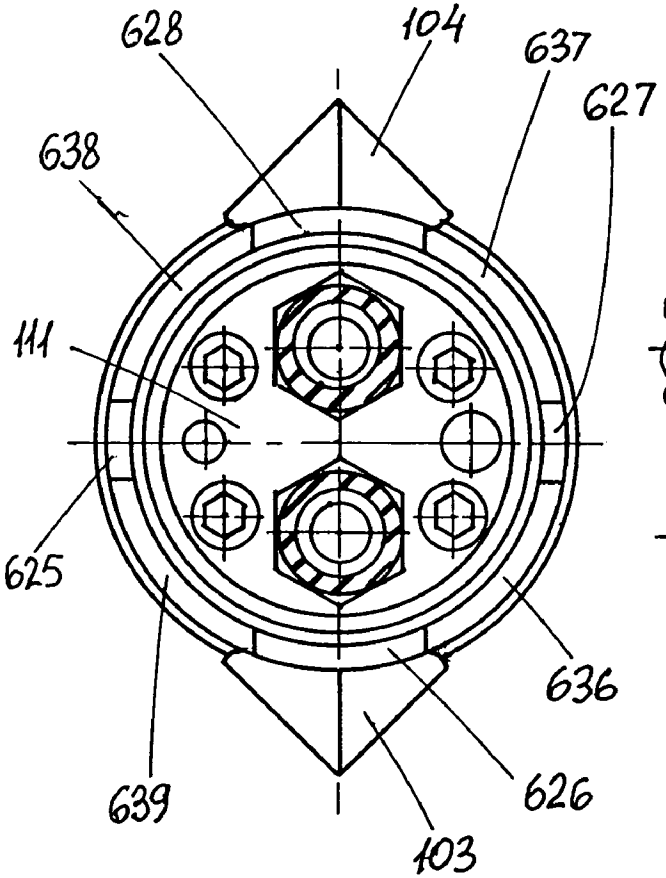
FIG. 10 is a left side view of the machine having integrated engagement means in its rear part.

FIGS. 10 and 11 illustrate a modification of the rear part of machine 90 having integrated engagement means. A collet-sleeve 402 with integrated engagement means 635 replaces protective sleeve 102. Longitudinal slots 625, 626, 627, and 628 are machined in collet-sleeve 500 in order to create flexible leafs 636, 637, 638, and 639 for accommodating the engagement means of an appropriate chisel of a second machine.

Figure 13:
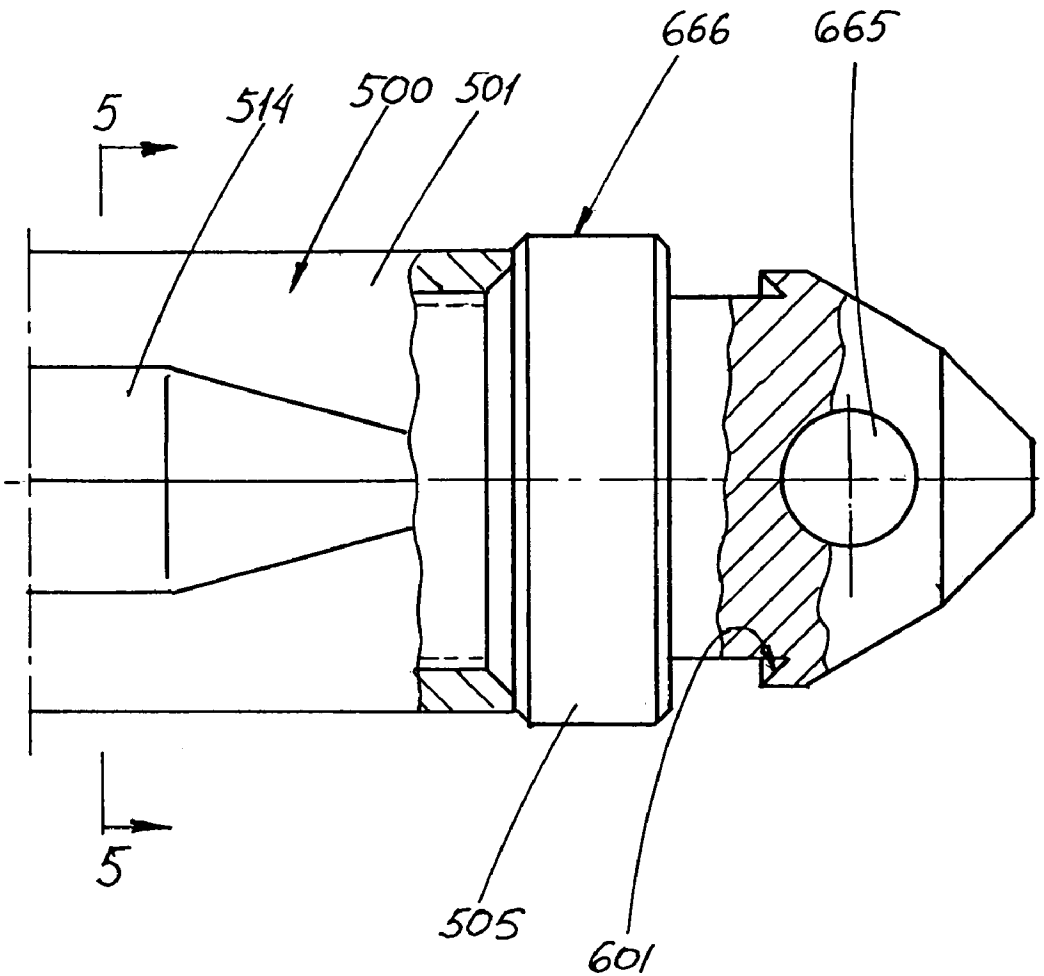
FIG. 13 is a partial longitudinal sectional view of the front part of the machine having a chisel with integrated engagement means for retraction of a failed machine.
Figure 12:
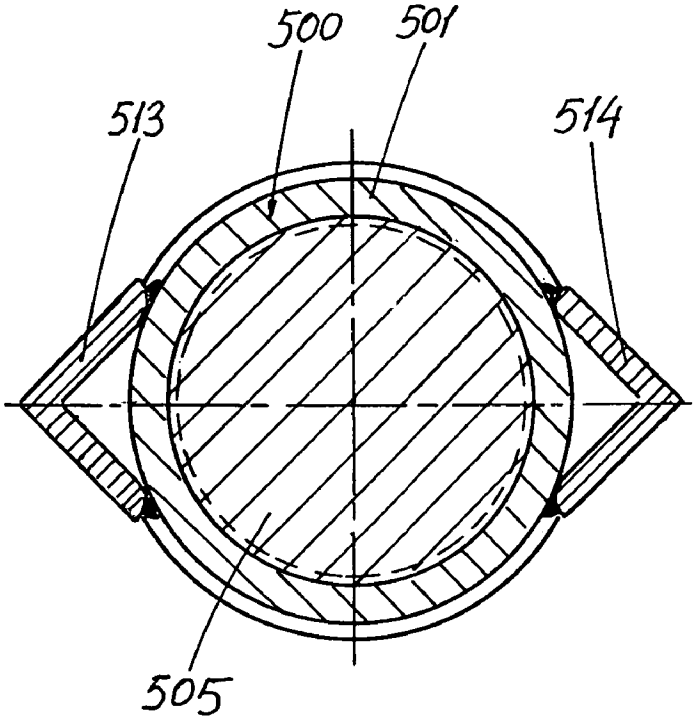
FIG. 12 is a cross-sectional view taken along the line 5-5 in FIG. 13.

FIGS. 12 and 13 are related to the front part of a machine 500, its tubular body 501 with the stabilizers 513 and 514 having a chisel 505 with integrated engagement means 601.

Figure 14:
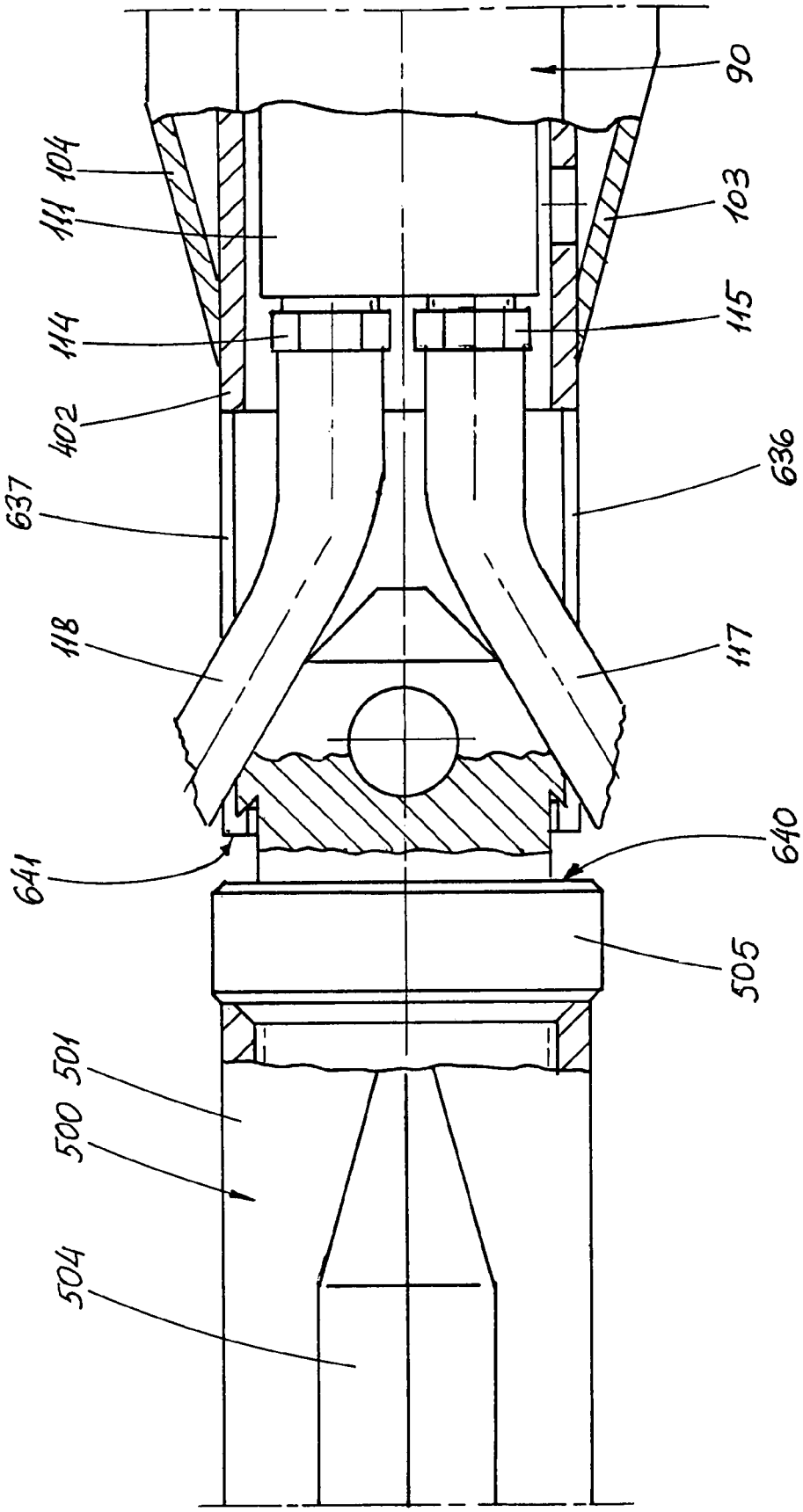
FIG. 14 is a partial longitudinal sectional view of a pair of machines in state of engagement for retraction.

FIG. 14 shows a pair of machines engaged during the process of retraction. Chisel 505 is engaged with collet-sleeve 402. Hoses 117 and 118 are bent and go out through the longitudinal slots in collet-sleeve 402. During retraction, hoses 117 and 118 will be pushed into the longitudinal spaces created in the soil by stabilizers 103 and 104.

Figure 15:
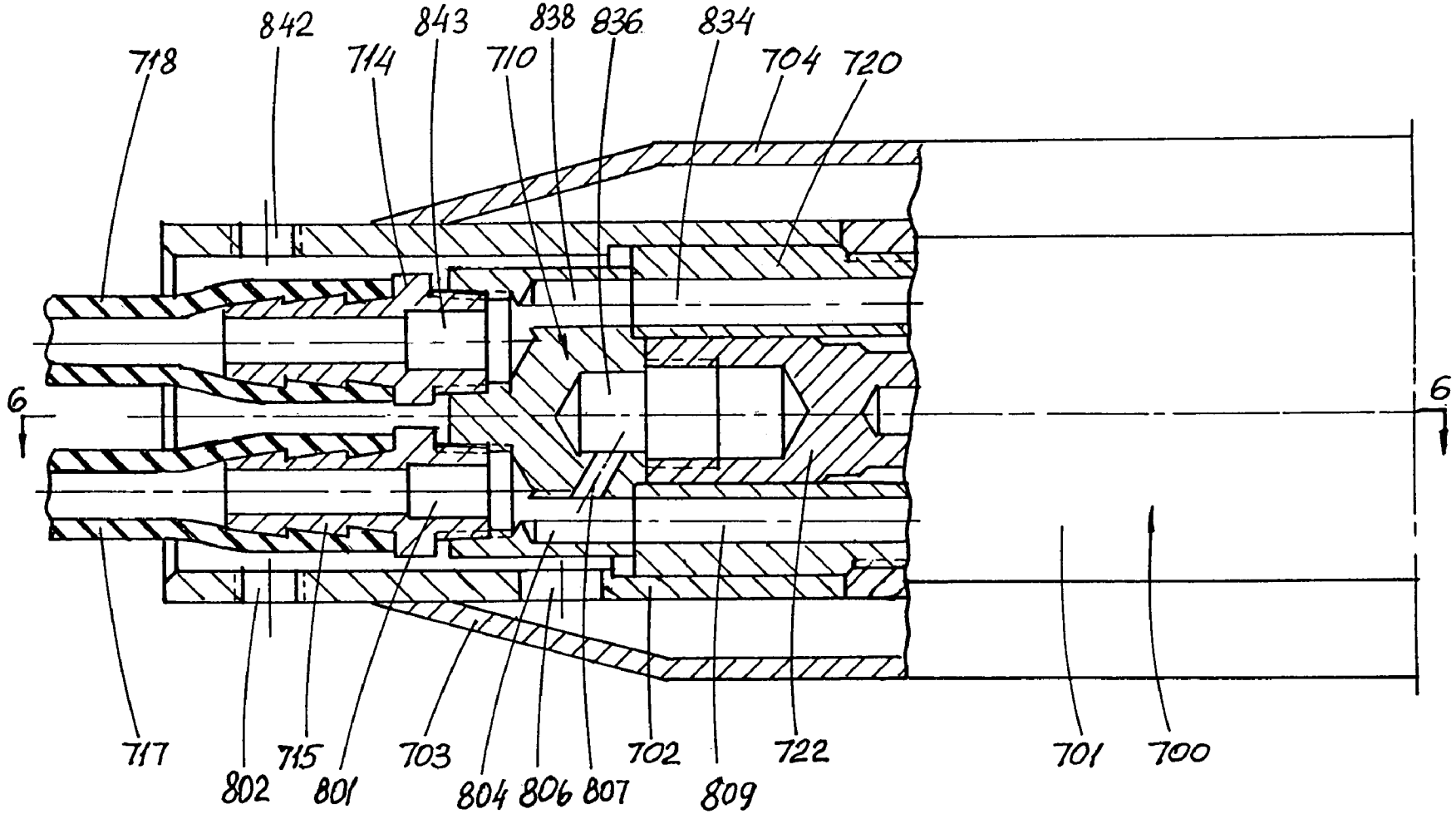
FIG. 15 is a partial longitudinal sectional view of the rear part of a simplified version of a machine with a flange attached to the front valve chest assembly.
Figure 16:
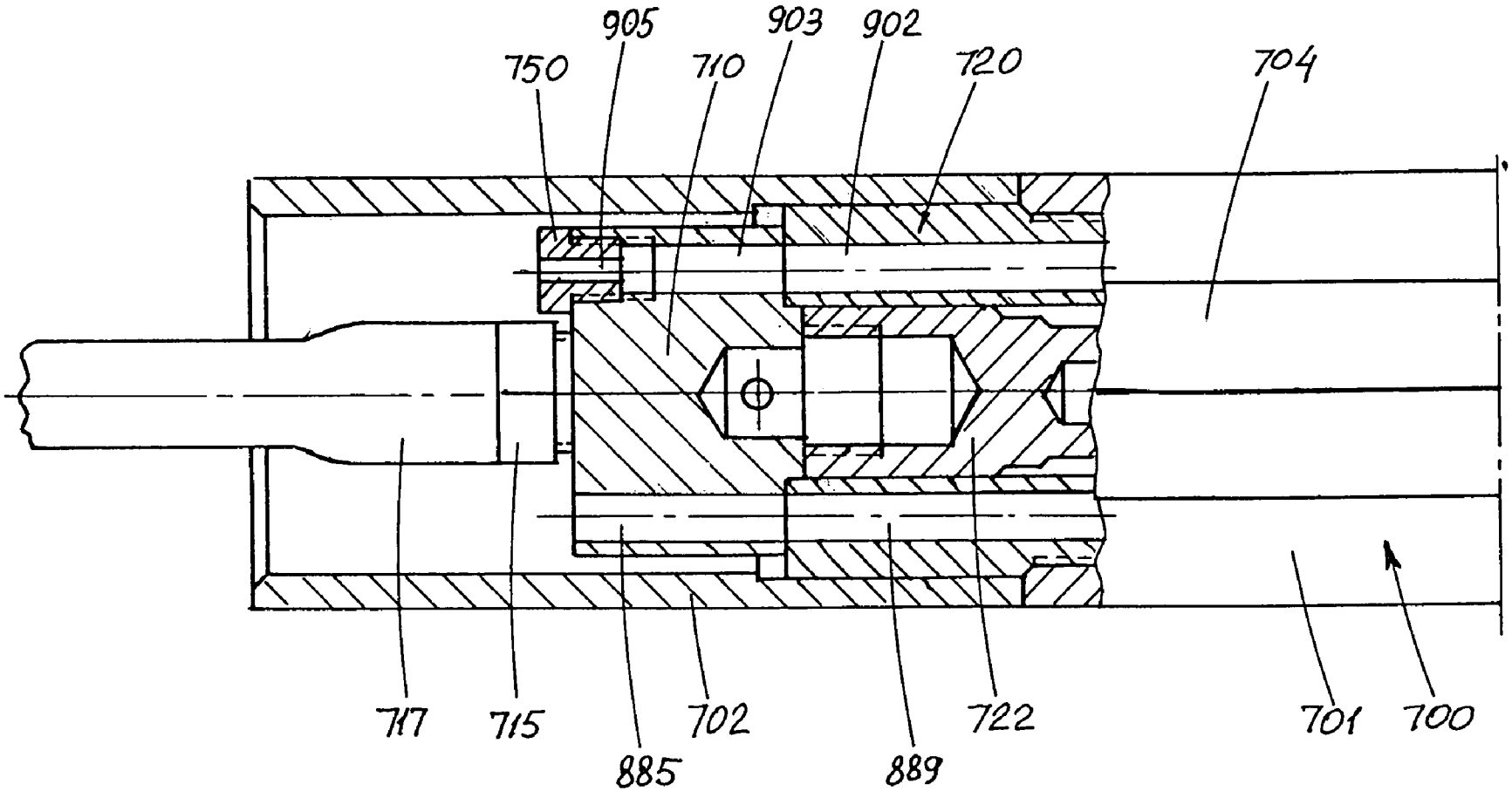
FIG. 16 is a partial longitudinal sectional view of the rear part of the machine with a flange taken along the line 6-6 in FIG. 15.

FIGS. 15 and 16 are related to the structural design of the modified version of the machine in which a flange 710 with hose barbs 714 and 715 replaces the rear valve chest assembly comprising the rear valve chest, the relief valve, and the stepped adapter.

Figure 2:
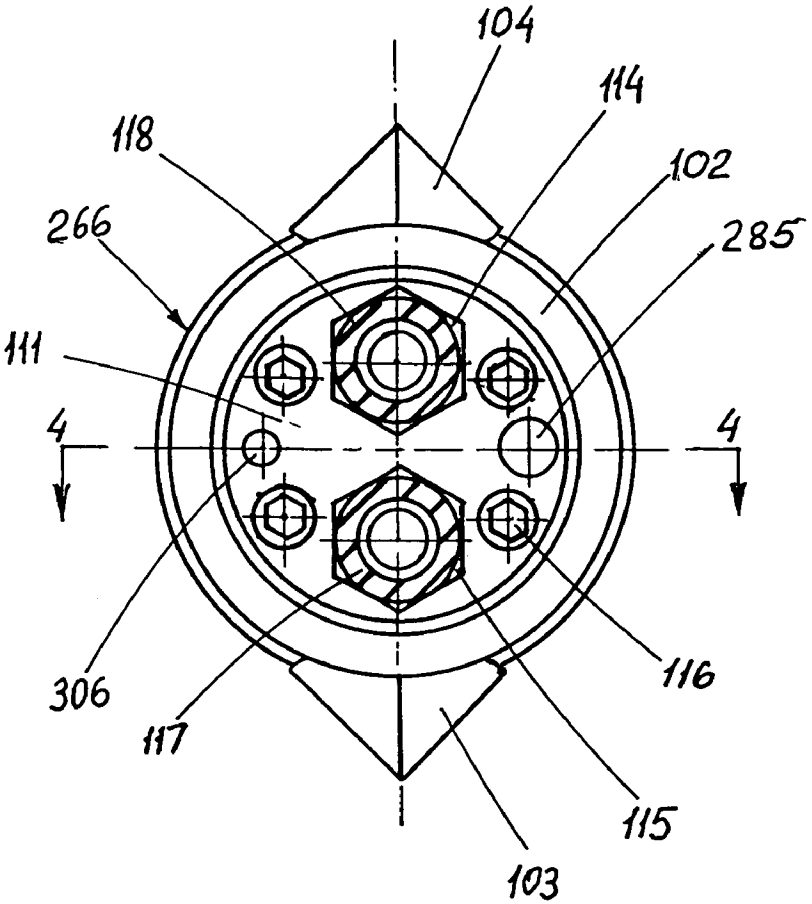
FIG. 2 is a left side view of the machine.
Figure 5:
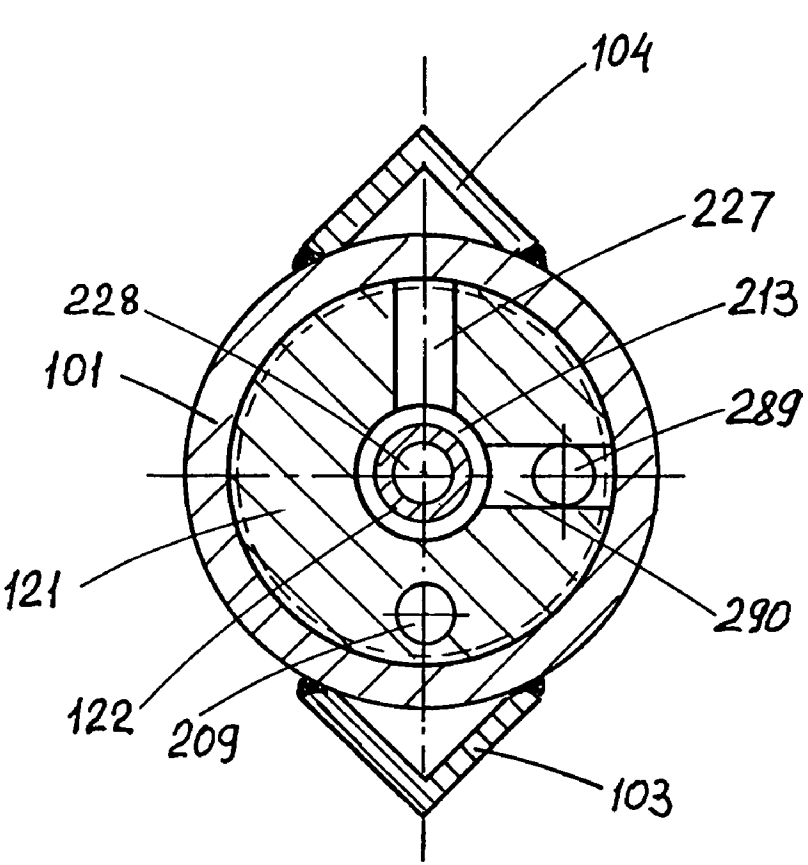
FIG. 5 is a cross-sectional view taken along the line 3-3 in FIG. 1A.
Figure 4:
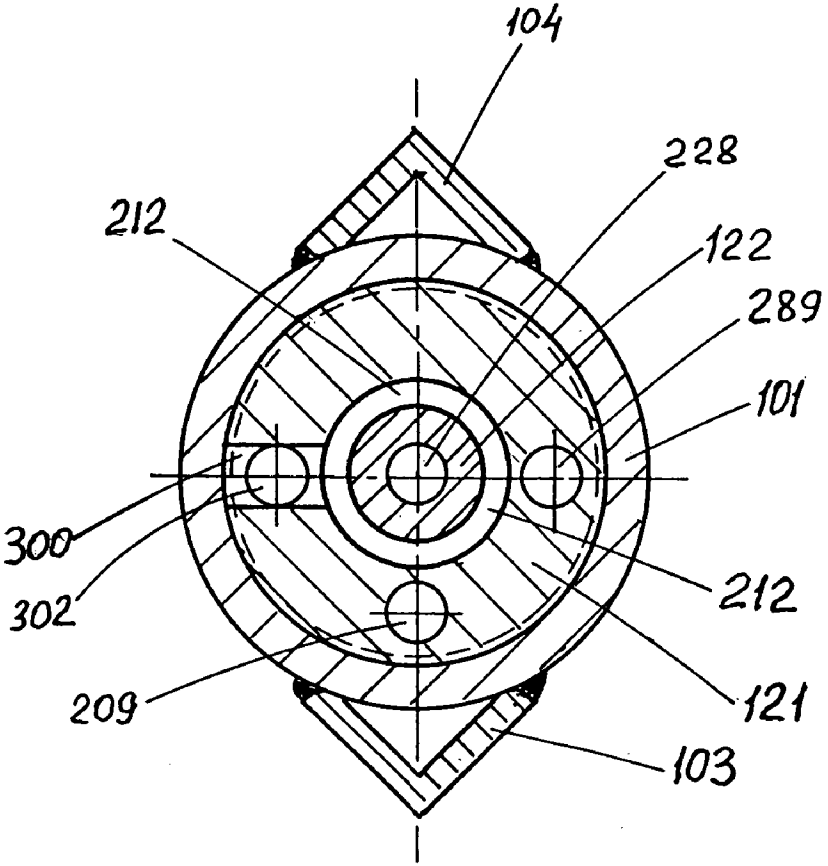
FIG. 4 is a cross-sectional view taken along the line 2-2 in FIG. 1A.

Flange 710 is rigidly secured to the front valve chest assembly by a group of bolts similar to the group of bolts 116 shown in FIG. 2.

The functioning of the machine and the interaction of its components will become apparent from the following description of the machine operation.

A. Machine Operation

In comparison with U.S. Pat. No. 5,467,831, the proposed pneumatically controlled differential air distributing mechanism eliminates the springs and the rear anvil assembly comprising a follower a spacer, and a rear anvil with its securing means. Eliminating the springs and transferring their functions to the compressed air prevents the failures of the air distributing mechanism associated with the breakdown of these springs. All springs in the numerous prototypes failed after about 15-20 hours of operation, thus it was necessary to frequently replace them in order to avoid failure. The proposed In comparison with U.S. Pat. No. 5,467,831, the proposed pneumatically controlled differential air distributing mechanism eliminates the springs and the rear anvil assembly comprising a follower a spacer, and a rear anvil with its securing means. Eliminating the springs and the rear anvil assembly solves the reliability problem of the air distributing mechanism and eliminates the need for preventive maintenance.

The machine has two modes of operation, namely forward and reverse. During the forward mode of operation, the air pressure in the nominal (high) pressure line is 100 psi (the conventional pressure of industrial compressors) and in the reduced (low) pressure line the air pressure is adjusted to about 35-40 psi. In this mode of operation relief valve 112 is in its extreme front (right) position (FIGS. 1A and 6) overlapping holes 286 and 304. During the reverse mode of operation, the air pressure in the nominal (high) pressure line is still 100 psi (however, some readjustment of this pressure may become desirable), but in the reduced (low) pressure line the air pressure is adjusted to 60-80 psi. In this mode of operation, relief valve 112 is in its extreme rear (left) position (FIG. 7) while radial holes 286 and 304 are communicating through annular space 203. It should be noted that the machine would operate at elevated or lowered nominal pressure with an appropriate adjustment of the reduced (low) pressure.

Figure 7:
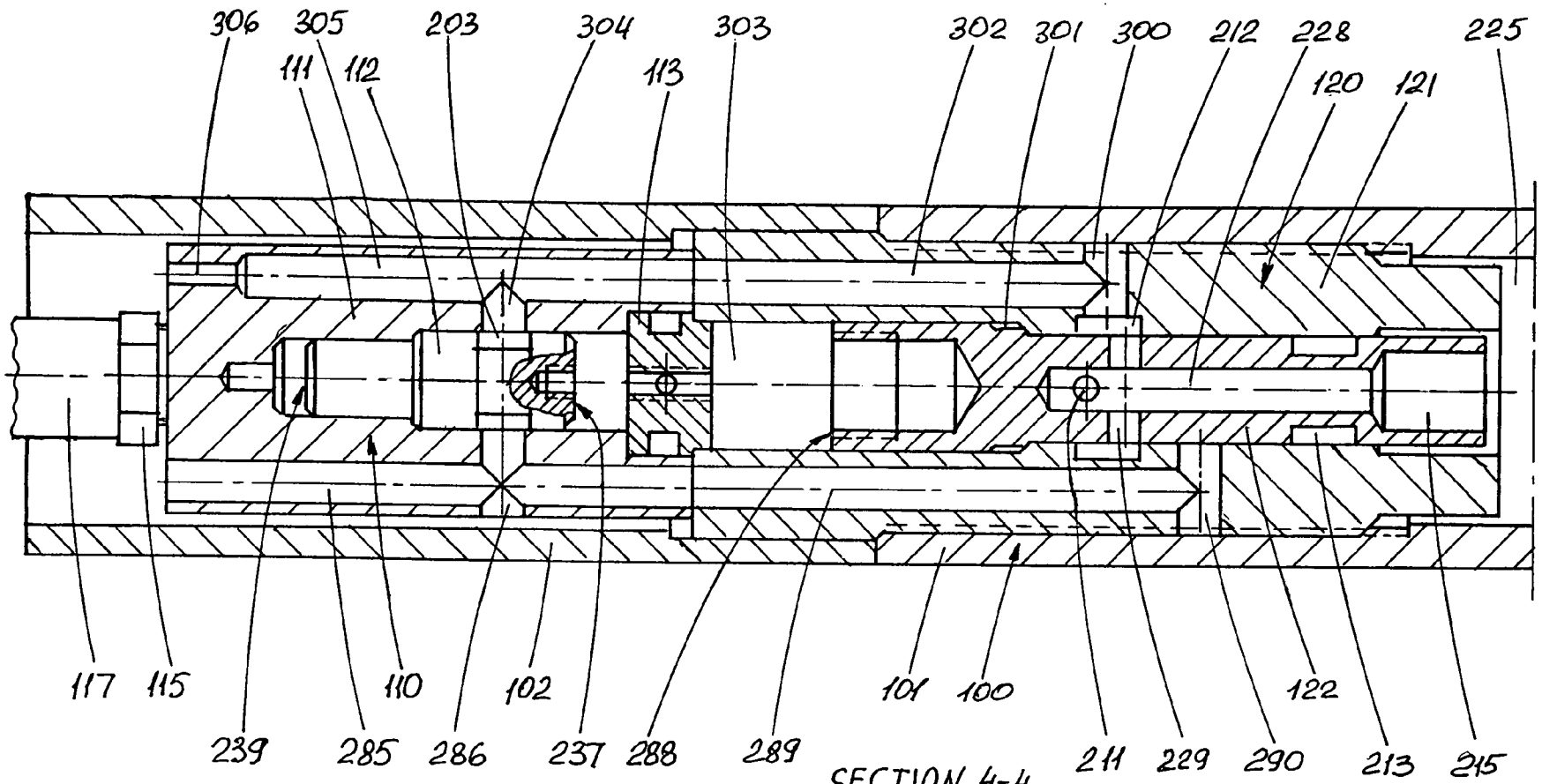
FIG. 7 is a revolved partial longitudinal sectional view similar to the view in FIG. 6, except with some components moved to their alternative positions.

During the operation of the machine, striker 131 cyclically reciprocates in tube 101, performing forward and backward strokes. During the forward stroke of striker 131, stroke control valve 122 (FIG. 1A) is in its extreme rear (left) position, while during the backward stroke of striker 131, stroke control valve 122 is in its extreme front (right) position (FIG. 7).

The functioning of the machine in both modes of operation will become apparent from the following description of the machine operation.

A.1. Forward Mode of Operation

There are three movable components in the proposed machine, namely relief valve 112, stroke control valve 122, and striker 131. Before the machine is pressurized, the positions of these three components are unpredictable. In order to start machine 90 the valves of the nominal (high) and reduced (low) pressure lines of the air control unit may be switched on in any order or simultaneously. Consider a complete cycle of machine operation, sequentially analyzing the three possible options for starting the machine: (1) first pressurizing the nominal (high) pressure line and then the reduced (low) pressure line, (2) first pressurizing the reduced (low) pressure line and then the nominal (high) pressure line, and (3) pressurizing both lines simultaneously. For all of these options, assume that the movable components of the machine are randomly located between their extreme front and rear positions.

Figure 6:
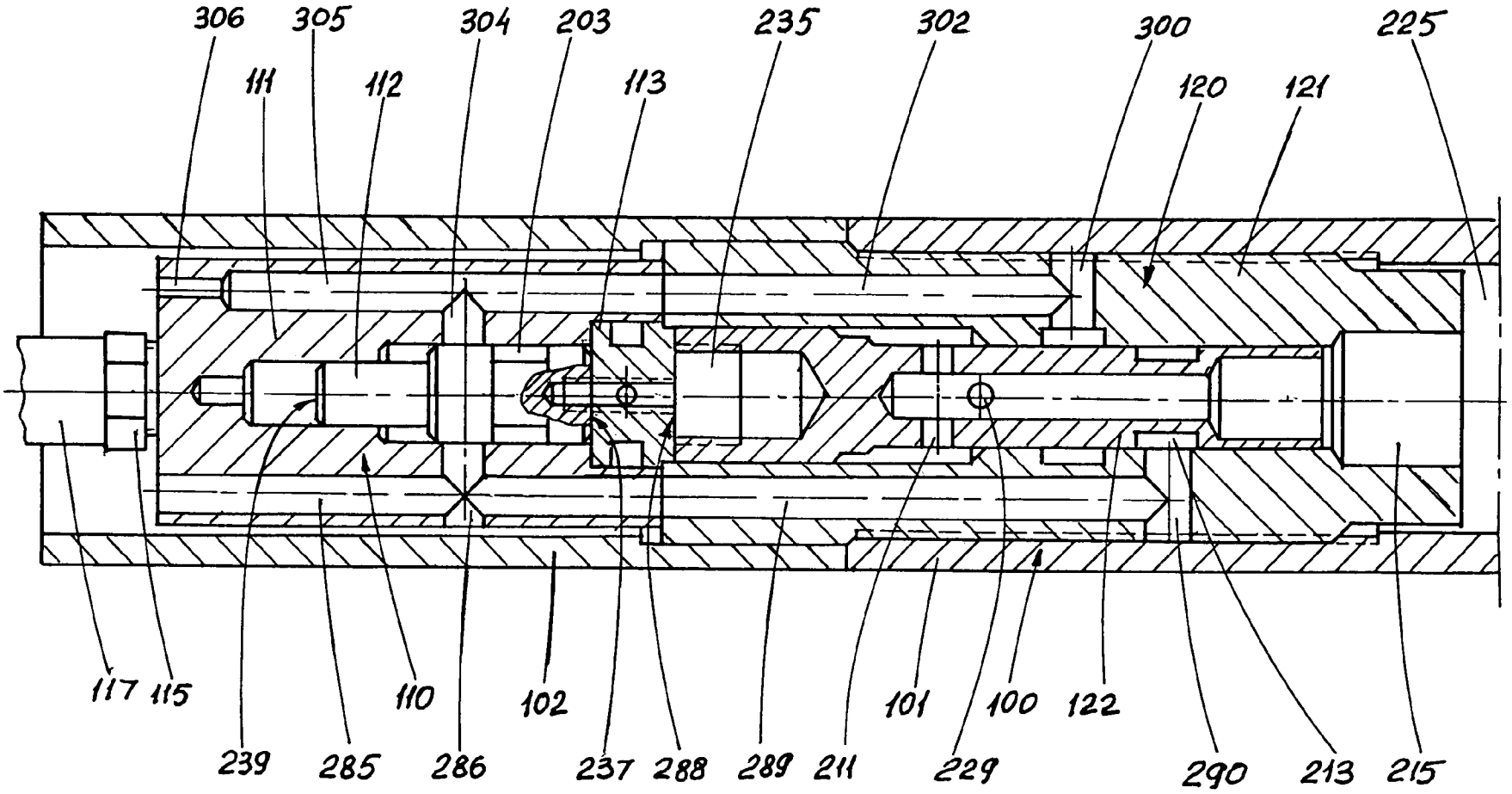
FIG. 6 is a revolved partial longitudinal sectional view taken along the line 4-4 in FIG. 2.

Consider the option of starting machine 90 by first pressurizing the nominal (high) pressure line (option 1). In this case, the compressed air will flow through hose 118, hose barb 114, barb hole 243, into inclined duct 241, and hole 240 developing a pressure on surface 239 and pushing relief valve 112 to its extreme front (right) position, in which radial holes 286 and 304 (FIG. 6) become overlapped. At the same time, the compressed air from barb hole 243 will go through longitudinal holes 238 and 234, and will enter into radial hole 231, and from there into annular space 233. It should be noted that even when stroke control valve 122 is in its extreme front (right) position and middle step 232 front chamfer is touching the chamfer of front chest 121, radial hole 231 is still partially open for communication with annular space 233, which becomes smaller in size, as shown in FIG. 7, and becomes annular space 301. The compressed air in annular space 233 (or 301) pushes stroke control valve 122 to its extreme rear (left) position and enters into forward stroke chamber 225 (FIG. 1C) through radial ducts 211 and 229, longitudinal hole 228, and cavity 215 (FIGS. 1A and 6) and pushes striker 131 forward, completing its forward stroke. During this stroke of striker 131, backward stroke chamber 255 is open to the atmosphere through radial duct 268 (FIG. 1C), longitudinal channel 230, radial duct 227, annular space 213, radial duct 290, and longitudinal holes 289 and 285 (FIGS. 1A and 6). When striker 131 approaches its extreme front (right) position, exhaust hole 251 becomes open to forward stroke chamber 225 and connects it to the atmosphere trough longitudinal channel 216, radial hole 206, and the annular space between protective sleeve 102 and rear valve chest 111. As a result of this, the air pressure in forward stroke chamber 225 drops significantly, however it continues to keep stroke control valve 122 in its extreme rear (left) position. Now, by pressurizing the reduced (low) pressure line, compressed air flows through hose 117, hose barb 115, and barb hole 201 into longitudinal hole 204, inclined duct 207, annular space 208, radial duct 205, into longitudinal threaded hole 236, and further into a cavity 235, pushing stroke control valve 122 to the front (right) and at the same time pushing relief valve 112 to the rear (left). As shown in FIGS. 1A, 6, and 7, relief valve 112 has a stepped shape and the cross-sectional areas corresponding to surfaces 237 and 239 of the steps are predetermined in such a way that during the forward mode of operation, when the air pressure in the reduced (low) pressure line is about 35-40 psi, the pressure force applied to surface 237 of the larger step, which pushes relief valve 112 to the rear (left), is less than the pressure force applied to surface 239, which pushes to the front (right). Thus, relief valve 112 remains in its extreme front (right) position during the forward mode of operation of machine 90. However, stroke control valve 122, being pushed by the pressure force applied to surface 288 by the air pressure in cavity 235 (FIG. 6), moves to its extreme front (right) position since the pressure in forward stroke chamber 225 has significantly dropped and cannot prevent stroke control valve 122 from moving to the front (right). In this position, chamfer 231 of stroke control valve 122 contacts the chamfer of front valve chest 121, annular space 233 becomes annular space 301 (FIG. 7), radial ducts 229 and 211 are no longer connected to annular space 301, and the compressed air at the nominal (high) pressure can no longer flow from radial duct 231 into forward stroke chamber 225. Also in this position of stroke control valve 122, radial ducts 227 and 290 become overlapped and radial ducts 214 and 226 become connected through annular space 213. Simultaneously, the compressed air at reduced (low) pressure flows through longitudinal holes 204 and 209, radial duct 214, annular space 213, radial duct 226, longitudinal channel 230 and radial duct 268 (FIG. 1C) into backward stroke chamber 255, pushing striker 13 to the rear (left). At this time, forward stroke chamber 225 is open to the atmosphere through cavity 215, longitudinal hole 228, radial ducts 211 and 229, annular space 212 (FIG. 7), radial duct 300, longitudinal holes 302 and 305 and orifice 306, which restricts the air flow from front stroke chamber 225 to the atmosphere and softens the impact between striker 131 and front (right) end 217 of front valve chest 121. Moving backward, striker 131 overlaps exhaust hole 251 and, as it approaches the end of its backward stroke, opens exhaust hole 260 (FIG. 1C), connecting backward stroke chamber 255 to the atmosphere through longitudinal channel 216 and radial duct 206 (FIG. 1A). Close to the end of its backward stroke, striker 131 pushes stroke control valve 122 to the rear (left) position with its tail 250 and imparts with its rear part 253 a relatively weak impact onto surface 217 of front valve chest 121. After stroke control valve 122 has moved to the rear (left) position, compressed air from the nominal (high) pressure line becomes reconnected with forward stroke chamber 225 through radial duct 231, annular space 233, radial ducts 211 and 219, longitudinal hole 228, and cavity 215. The air pressure from forward stroke chamber 225 applied to the front (left) end of stroke control valve 122 exceeds the air pressure in cavity 235 applied to the rear (left) end of stroke control valve 122 which remains in its extreme rear (left) position and the forward stroke of striker 131 begins. At the end of its forward stroke, striker 131 imparts a heavy impact to anvil 267, causing an incremental penetration of machine 90 into the medium, and the cycle repeats itself.

Consider the option of starting the machine by first pressurizing the reduced (low) pressure line and then the nominal (high) pressure line (option 2). In this case, the compressed air will flow trough hose 117, hose barb hole 201, longitudinal hole 204, inclined duct 207, annular space 208, radial duct 205, longitudinal threaded hole 236, into cavity 235 and will simultaneously push stroke control valve 122 to its extreme front (right) position and relief valve 112 to its extreme rear (left) position. At the same time, the compressed air through longitudinal hole 209, radial duct 214, annular space 213, radial duct 226, longitudinal channel 230, and radial duct 268 will flow into backward stroke chamber 255, pushing striker 131 to the rear (left). Forward stroke chamber 225 becomes open to the atmosphere through cavity 215, radial ducts 211 and 229, annular space 212, radial duct 300, longitudinal holes 302 and 305, and orifice 306 and additionally through radial duct 304, annular space 203, radial duct 286 and radial hole 285. Then, by pressurizing the nominal (high) pressure line, the compressed air will flow through hose 118, hose barb hole 243, inclined duct 241, and longitudinal hole 240, and will develop a pressure force applied to surface 239, pushing relief valve 112 to its extreme front (right) position, in which radial ducts 286 and 304 become overlapped. At the same time, the compressed air through longitudinal hole 234 and radial duct 231 will enter into annular cavity 301 (FIG. 7), which in this case, cannot communicate with Forward stroke chamber 225. The pressure force applied to the annular cross-sectional area of annular space 301 is not sufficient to overcome the opposing pressure force applied to the larger step of stroke control valve 122 (associated with cavity 303), which remains in its extreme front (right) position, allowing striker 131 to complete its backward stroke. Upon completion of the backward stroke striker 131 moves stroke control valve 122 to its extreme rear (left) position and a forward stroke begins after which the cycle repeats itself.

In the case when both pressure lines are pressurized simultaneously (option 3), the machine will start to operate according to one of the two considered options described above depending on the initial positions of the movable components.

Figure 8:
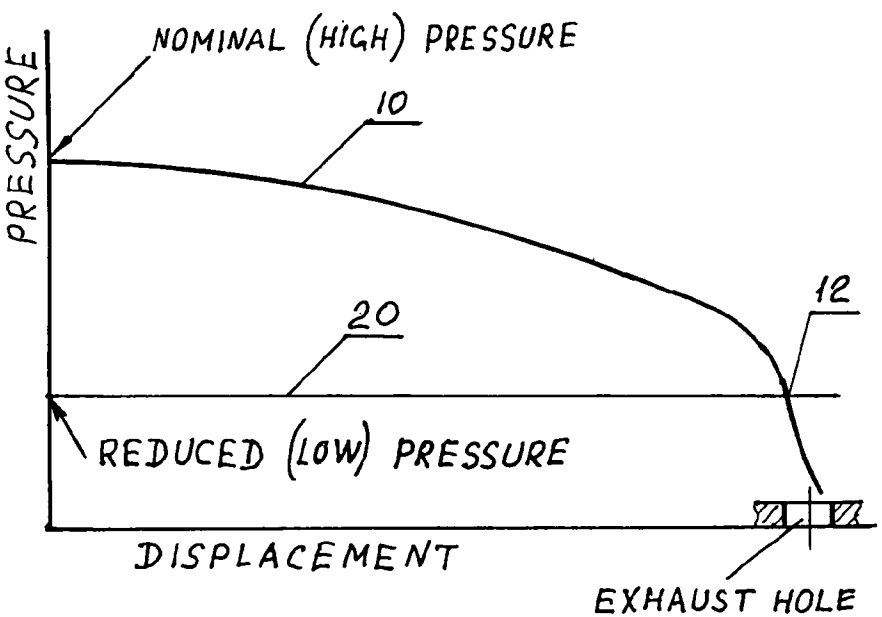
FIG. 8 consists of graphs characterizing the air pressure acting inside of the forward stroke chamber (curved line) and pushing the stroke control valve to the rear (left) and the air pressure applied to the left end of the stroke control valve (straight line) pushing it to the front (right) during the forward stroke of the striker in forward mode of operation.

In FIG. 8, curve 10 characterizes the air pressure in forward stroke chamber 225 and straight line 20 characterizes the air pressure in cavity 235, both as a function of the displacement of striker 131. As reflected by curve 10, the air pressure inside of the forward stroke chamber 225 begins to drop from its nominal (high) value while striker 131 begins to perform the forward stroke, however, at the same time the pressure in cavity 235, as reflected by line 20, remains constant. Approaching the end of the forward stroke, striker 131 opens exhaust hole 251, the air pressure in forward stroke chamber 225 abruptly decreases, and when it drops below point 12 on curve 10, the reduced (low) air pressure in cavity 235 causes stroke control valve 122 to move to its front (right) position. At the end of the forward stroke front part 252 of striker 131 imparts a strong impact to rear part 267 of chisel 105 resulting in an incremental penetration of machine 90 into the medium. At the end of the forward stroke of striker 131 compressed air from the reduced (low) air pressure line enters into backward stroke chamber and the cycle repeats itself.

A.2. Reverse Mode of Operation

The machine works in reverse mode when the pressure in the reduced (low) air pressure line is about 65-80 psi, while the pressure in the nominal (high) pressure line remains at 100 psi. In order to switch machine 90 from one mode of operation to another, it is necessary to readjust the pressure in the reduced (low) pressure line with a conventional pressure regulator. The procedure takes just a few seconds, and can be done an unlimited number of times, with the machine in any mode of operation (or not operating at all). It should be noted that there are many similarities in the functioning of the components and air passages during the forward and reverse modes of operation.

In order to describe one cycle of reverse mode operation, consider the case where the machine is started from a stop by first pressurizing the reduced (low) pressure line and then the nominal (high) pressure line. As shown in FIGS. 1A and 2, the compressed air enters through hose 117, hose barb 115, barb hole 201, longitudinal hole 204, inclined duct 207, and annular space 208, into longitudinal threaded hole 236 and, developing a pressure force applied to surface 237, pushes relief valve 112 to its extreme rear (left) position (FIG. 7). In this position, annular space 203 coincides with radial ducts 304 and 286, connecting longitudinal holes 285 and 305 to each other. At the same time, the compressed air enters into cavity 235 (which becomes cavity 303) and, being applied to surface 288, pushes stroke control valve 122 to its extreme front (right) position (FIG. 7). In this position annular space 212 coincides with radial duct 300 and annular space 213 (FIG. 1A) coincides with radial ducts 214 and 226 and opens the way for the compressed air to flow through longitudinal hole 209, radial duct 214, annular space 213, radial duct 226, longitudinal channel 230, and radial duct 268 (FIG. 1C) into backward stroke chamber 255, causing striker 131 to begin its backward stroke. During the backward stroke, forward stroke chamber 225 is open to the atmosphere through cavity 215, longitudinal hole 228, radial ducts 211 and 219, annular space 212, radial duct 300, longitudinal holes 302 and 305, orifice 306, and additionally through radial duct 304, annular space 203, radial duct 286 and longitudinal hole 285. In the reverse mode of operation, the air flow from forward stroke chamber 225 during the backward stroke of striker 131 is not restricted by orifice 306 (as it is in the forward mode of operation). This increases the impact energy of striker 131. Approaching the end of its backward stroke, striker 131 pushes stroke control valve 122 to the rear (left), imparts by its rear part 253 a relatively strong impact to the front part 217 of front chest 121, and machine 90 performs an incremental displacement in the backward direction. A short instance prior to the end of its backward stroke, striker 131 opens exhaust duct 260 (FIG. 1C), connecting backward stroke chamber 255 through longitudinal channel 216 and radial hole 206 to the atmosphere.

Now, pressurizing the nominal (high) air pressure line allows the compressed air to flow through hose 118, hose barb 114, barb hole 243, longitudinal holes 238 and 234, annular space 233, radial ducts 211 and 219, longitudinal hole 228, and cavity 215 into forward stroke chamber 225, and striker 131 begins its forward stroke. Simultaneously, the compressed air from hole 242, through inclined duct 241, and hole 240 enters into the rear cavity of rear valve chest 111 and develops a pressure force applied to surface 239 of relief valve 112; however, this force is less than the pressure force applied to surface 237, and, as a result, relief valve 112 remains in its extreme rear (left) position during the reverse mode of operation. During the forward stroke of striker 131, backward stroke chamber 255 is open to the atmosphere through radial duct 268, longitudinal channel 230, radial duct 227, annular space 213, radial duct 290 (FIG. 6) and longitudinal holes 289 and 285.

Figure 9:
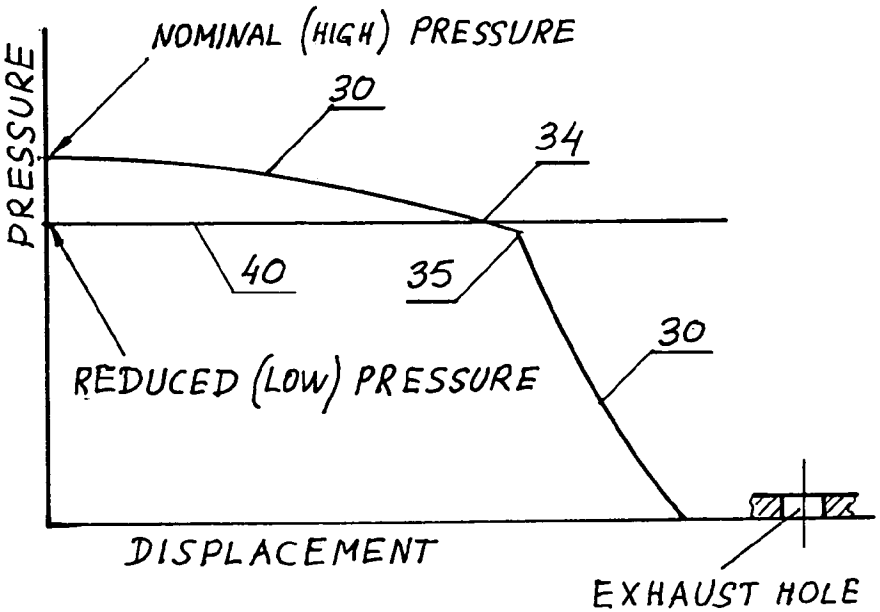
FIG. 9 consists of graphs characterizing the air pressure acting inside of the forward chamber (curved line) and pushing the stroke control valve to the rear (left) and the air pressure applied to the left end of the stroke control valve (straight line) pushing it to the front (right) during the forward stroke of the striker in the reverse mode of operation.

In FIG. 9, curve 30 characterizes the air pressure in forward stroke chamber 225 and straight line 40 characterizes the air pressure in cavity 235, both as a function of the displacement of striker 131. It should be noted that during the reverse mode of operation, the air pressure in cavity 235 remains constant (line 40 in FIG. 9). At point 34 (FIG. 9) the pressures in cavity 235 and forward stroke chamber 225 become equal and at point 35, when the pressure in cavity 235 slightly exceeds the pressure in forward stroke chamber 225, stroke control valve 122 moves to its extreme front (right) position, cutting off the air supply to forward stroke chamber 225, which becomes open to the atmosphere. The air pressure in this chamber abruptly drops, and compressed air at reduced pressure (65-80 psi) enters into backward stroke chamber 255 and slows down the motion of striker 131, preventing it from impacting chisel 105. Striker 131 slows down to a stop and reverses direction, beginning its backward stroke, and the cycle repeats itself.

B. Retracting a Failed Machine

It is possible that the machine stops operating due to a blown hose or another unexpected failure. According to U.S. Pat. No. 5,457,831, a failed machine can be retracted from the hole by an identical machine with the help of a special engaging attachment that is mounted on the front part of the second machine. This attachment has engagement means capable of engaging with the appropriate engagement means of the rear part of the failed machine. The present invention offers a machine with integrated engagement means in its front and rear parts, eliminating the need for a special engaging attachment.

FIGS. 10 and 11 show the modification of machine 90 in which protective sleeve 102 (FIG. 1A) is replaced with collet-sleeve 402, having engagement means 635 representing a group of flexible leafs 636, 637, 638, and 639. These leafs are created by cutting appropriate longitudinal slots 625, 626, 627, and 628 in the sleeve. Slots 626 and 628 are wider than the diameter of hoses 117 and 118. The engagement means may have a dovetail or another appropriate shape.

FIGS. 12 and 13 illustrate a modified chisel 505, having dovetail-shaped cutout 601 or another appropriately shaped groove for engaging with the engagement means in the tail of an identical machine. In these figures, the machine is revolved 90 degrees about its longitudinal axis.

FIG. 14 illustrates the engagement of machine 90, having collet-sleeve 402, with machine 500. It is assumed that machine 90 failed in the underground hole and machine 500 (revolved 90 degrees so that the stabilizers of machine 500 do not interfere with the hoses of machine 90, which get pushed into the spaces created by the stabilizers of machine 90) penetrated into the same hole in order to retract machine 90 or push it forward. The sharpened part of chisel 505 penetrates into collet-sleeve 402 bending outward flexible leafs 636, 637, 638, and 639 and pushing out hoses 117 and 118 through slots 626 and 628, and engaging with collet-sleeve 402. Reversing machine 500 will result in machine 90 being retracted. In some cases it is more desirable to push the failed machine forward in order to complete the hole. In such cases, machine 500 continues forward after engaging with machine 90, contacting surface 641 of collet-sleeve 402 with surface 640 of chisel 505, resulting in machine 90 being pushed forward.

There are threaded holes in each leaf of collet-sleeve 402 (not shown in the drawing) that allow appropriate bolts to be screwed in to bend the leaves out and disengage the machines.

C. Modification of the Machine for Applications in Specific Conditions

The present invention offers a modification of the machine for special applications such as expanding holes, making boreholes in heavy soils, making ventilation holes in mines, penetrating into the medium to deliver explosives, making vertical boreholes, enlarging the diameters of old pipes by breaking them during penetration, etc. The working processes of the machines in these conditions can be subdivided into two groups: those that require just the forward mode of operation, and those that require both forward and reverse modes of operation, however, during the forward mode, the striker should not be braked by the orifice that restricts the air flow on the backward stroke. In general working conditions it is desirable to soften the backward impact of the striker during the forward mode of operation. In specific conditions (for instance, in making vertical boreholes) the weight of the striker will cause some softening of the backward impact. In addition, due to the elimination of the springs and O-ring, a decreased pressure in the reduced (low) pressure line is required, which by itself contributes to the softening of the backward impact. Based on considerations characterizing the two groups of working processes, it is possible to modify the machine to simplify its design and reduce its cost. In the modified machine the rear valve chest, the relief valve, and the stepped adapter are eliminated and replaced by an appropriate flange.

FIGS. 15 and 16 illustrate the modified design of a machine 700 comprising a flange 710, a shortened protective sleeve 702, and the following components and assemblies that are completely identical with machine 90: a tubular body 701, a front valve chest assembly 720 with a stroke control valve 722, stabilizers 703 and 704, hose barbs 714 and 715, hoses 717 and 718, a striker assembly and a chisel (not shown in the drawing). Duct 903 in flange 710 plays the same role as longitudinal hole 305 in machine 90, connecting the forward stroke chamber to the atmosphere during the backward stroke of the striker. As it was discussed earlier, longitudinal hole 305 ends with orifice 306, which restricts the air flow from the forward stroke chamber when the striker is performing its backward stroke during the forward mode operation. A similar air flow restriction can be achieved by inserting into duct 903 a removable threaded bushing 750 having an orifice 905 or installing another means for controlling the air flow from duct 903. The operation of machine 700 is similar to the operation of machine 90, however for complete clarity, some of the air flow ways are discussed below. The compressed air at the nominal (high) pressure is delivered through hose 718, longitudinal hole 843, duct 838, longitudinal hole 834 (similar to hole 234 of machine 90) and continues to flow as it was described for machine 90. Compressed air at reduced (low) pressure is delivered through hose 717, longitudinal hole 801, duct 804, inclined duct 807 entering into cavity 836 and pushing stroke control valve 722 to the front (right) and at the same time entering into longitudinal hole 809 (similar to hole 209 in machine 90) and continuing to flow as it was described for machine 90. Hole 806 is similar to hole 206 of machine 90 and is used to exhaust the compressed air. During the backward stroke of the striker, the forward stroke chamber is connected to the atmosphere trough longitudinal hole 902 (similar to longitudinal hole 302 in machine 90), duct 903 (similar to longitudinal hole 305 in machine 90) and orifice 905 of removable threaded bushing 750. This is for the working process of the first group that requires just the forward mode of operation. For the working process of the second group requiring both modes of operation, removable threaded bushing 750 should be taken out or the air flow controlling means should be properly readjusted, eliminating the restriction of the air flow in duct 903. The backward stroke chamber during the forward stroke of the striker is connected to the atmosphere through longitudinal hole 889 (similar to longitudinal hole 289 in machine 90) and duct 885.

D. Reduction of Lateral Friction

During the soil penetration process, the soil exerts resistance forces onto the lateral surface of the machine (normally called skin friction forces), and frontal resistance forces applied to the sharpened part of the chisel of the penetrating machine. In the reverse mode of operation of the machine the soil exerts just the lateral friction resistance. Reducing the lateral friction resistance to a certain extent will result in improvement of the performance of the machine in both modes of operation. Appropriate enlargement of the chisel diameter 266 and 666, as shown in FIGS. 1C and 13, relative to the outside diameter of the tubular body of the machine will create a annular gap between the soil and the tubular body, eliminating the lateral friction between the tube and soil. However, longitudinal directional stabilizers 103 and 104 (FIGS. 1A, and 2-5) or 513 and 514 FIGS. 12 and 13) will remain in contact with the soil, guiding the machine and developing the lateral friction resistance necessary for normal operating of the machine.

E. Using Accessories

The machine allows the use of numerous related accessories. Threaded holes 202 and 242 (FIG. 1A) as well as 802 and 842 (FIG. 15) are intended for securing hole expanders and other accessories. Hole 265 (FIG. 1C) and hole 665 (FIG. 13) allow the attachment of pulling devices for applications associated with the reverse mode of operation. Engagement means 635 (FIG. 11) may accommodate pulling attachments during the forward mode of operation. Engagement means 601 (FIG. 13) can be used for connecting pulling accessories during the reverse mode of operation.

What is claimed is:

1. A reversible penetrating machine with a pneumatically controlled differential air distributing mechanism, comprising:

a tubular housing assembly, including a tube that has a sharpened chisel rigidly installed into its front part and a front valve chest installed into its rear part, a protective sleeve attached to said front valve chest and said tube, and structurally shaped longitudinal directional stabilizers rigidly attached to the lateral surface of said tube and said protective sleeve, creating longitudinal air channels between the internal surfaces of said stabilizers and outer surfaces of said tube and said protective sleeve;

a striker assembly reciprocating inside of said tube, creating a forward stroke chamber in the space between its rear part and the front part of said front valve chest, a backward stroke chamber in the space between its front part and the rear part of said chisel, and cyclically imparting impacts to the rear part of said chisel during the forward mode of operation and to the front part of said front valve chest during the reverse mode of operation, including a striker, a pair of bushings rigidly installed on both ends of said striker, and means for keeping said bushings in place;

a pneumatically controlled differential air distributing mechanism installed in the rear part of said tube, controlling the air flow causing reciprocating motion of said striker assembly such that during the forward stroke of said striker assembly, when said forward stroke chamber is pressurized, said backward stroke chamber is open to the atmosphere, while when said backward stroke chamber is pressurized causing said striker assembly to perform the backward stroke, said forward stroke chamber is open to the atmosphere, including said front valve chest accommodating a double stepped stroke control valve that is permanently pneumatically controlled during said machine operation, a rear valve chest carrying a pair of hose barbs with hoses for the nominal (high) air pressure line and reduced (low) air pressure line, a stepped relief valve, that is permanently pneumatically controlled during said machine operation, reciprocating inside of said rear valve chest, which is aligned by a stepped adapter, having air ducts, with said front valve chest and rigidly attached to it by a group of bolts.

2. A machine of claim 1, wherein said double stepped stroke control valve being in its extreme front (right) position and cutting off said forward stroke chamber from said nominal (high) pressure line still keeps open a radial duct in said front valve chest allowing the compressed air at said nominal (high) pressure to move said double stepped stroke control valve to the rear (left) position, enabling the starting of said machine.

3. A machine of claim 1, wherein, during said machine operation, said double stepped stroke control valve is permanently and simultaneously pneumatically controlled by the air pressure of said nominal (high) pressure and said reduced (low) air pressure applied to opposite surfaces of said double stepped stroke control valve providing appropriate functioning of said striker assembly.

4. A machine of claim 1, wherein, during said machine operation, said stepped relief valve is permanently and simultaneously pneumatically controlled by the air pressure of said nominal (high) pressure and said reduced (low) air pressure applied to the forehead surfaces of smaller and larger steps causing a restricted air flow from said forward stroke chamber to the atmosphere in the forward mode of operation and unrestricted air flow from said forward stroke chamber in the reverse mode of operation.

5. A machine of claim 1, wherein said chisel is replaced with a chisel having in its front part integrated engagement means that can be engaged with respective engagement means in the rear part of a failed identical machine for retracting from a hole or pushing forward said failed machine and for accommodating appropriate accessories.

6. A machine of claim 1, wherein said protective sleeve in the rear part of said machine is replaced with a collet-sleeve having in its rear part integrated engagement means that can be engaged with respective engagement means in the front part of an identical machine for retracting from a hole or pushing forward said machine in case of its failure and for accommodating appropriate accessories.

7. A machine of claim 1, wherein the diameter of the cylindrical part of said chisel is enlarged to create an annular gap between the soil and the lateral cylindrical surface of said tubular body in order to reduce the lateral frictional resistance of the medium during said machine operation.

8. A reversible penetrating machine with a pneumatically controlled differential air distributing mechanism, comprising:

a tubular housing assembly, including a tube, having rigidly installed into its front part a sharpened chisel and a front valve chest into its rear part, a protective sleeve attached to said front valve chest and said tube, and structurally shaped longitudinal directional stabilizers rigidly attached to the lateral surface of said tube and said protective sleeve, creating longitudinal air channels between the internal surfaces of said stabilizers and outer surfaces of said tube and said protective sleeve;

a striker assembly reciprocating inside of said tube, creating a forward stroke chamber in the space between its rear part and the front part of said front valve chest, a backward stroke chamber in the space between its front part and the rear part of said chisel, and cyclically imparting impacts to the rear part of said chisel during the forward mode of operation and to the front part of said front valve chest during the reverse mode of operation, including a striker, a pair of bushings rigidly installed on both ends of said striker, and means for keeping said bushings in place;

a pneumatically controlled differential air distributing mechanism installed in the rear part of said tube controlling the air flow causing the reciprocating motion of said striker assembly in a way that during the forward stroke of said striker assembly, when said forward stroke chamber is pressurized, said backward stroke chamber is open to the atmosphere, while when said backward stroke chamber is pressurized causing said striker assembly to perform the backward stroke, said forward stroke chamber is open to the atmosphere, including said front valve chest accommodating a double stepped stroke control valve that is permanently pneumatically loaded during said machine operation, a stepped flange with appropriate air ducts, a pair of hose barbs with hoses for the nominal (high) air pressure line and reduced (low) air pressure line and is rigidly attached to said front valve chest by a group of bolts.

9. A machine of claim 8, wherein said stepped flange accommodates a removable bushing or an air flow controlling means having an appropriate orifice for restricting the air flow from said forward stroke chamber to the atmosphere during the forward mode of operation of said machine.

* * * * *